US008096619B2

(12) United States Patent
Tseng

(10) Patent No.: US 8,096,619 B2
(45) Date of Patent: Jan. 17, 2012

(54) FOLDABLE LEISURE CHAIR

(75) Inventor: Chuen-Jong Tseng, Chiayi Hsien (TW)

(73) Assignee: Taiwan Shin Yeh Enterprise Co., Ltd., Chiayi Hsien (TW)

( * ) Notice: Subject to any disclaimer, the term of this patent is extended or adjusted under 35 U.S.C. 154(b) by 85 days.

(21) Appl. No.: 12/779,264

(22) Filed: May 13, 2010

(65) Prior Publication Data

US 2011/0278897 A1 Nov. 17, 2011

(51) Int. Cl.
*A47C 7/54* (2006.01)
*A47C 4/00* (2006.01)

(52) U.S. Cl. ..... 297/411.33; 297/40; 297/115; 297/360

(58) Field of Classification Search ..... 297/40, 297/115, 359, 360, 411.33, 411.39, 377
See application file for complete search history.

(56) References Cited

U.S. PATENT DOCUMENTS 1,185,181 A * 5/1916 Collins ..... 297/40
3,179,467 A * 4/1965 Hobel ..... 297/359
6,761,397 B1 * 7/2004 Tseng ..... 297/40
7,021,717 B2 * 4/2006 Gaylord et al. ..... 297/411.33
7,281,767 B2 * 10/2007 Gaylord et al. ..... 297/411.33

* cited by examiner

*Primary Examiner* — Anthony D Barfield
(74) *Attorney, Agent, or Firm* — Trop, Pruner & Hu, P.C.

(57) ABSTRACT

A foldable leisure chair includes a seat unit having a pair of side frames, a pair of armrest members connected pivotally and respectively to the side frames, and a pair of support units. Each support unit includes a coupling seat defining a receiving space therein and having a pivot end part that is connected pivotally to a respective side frame, a seat-engaging rod having an engaging end part that extends telescopically into the receiving space and a connecting end part that is connected pivotally to a corresponding armrest member, and an adjusting mechanism disposed in the receiving space for positioning the seat-engaging rod relative to the coupling seat so as to maintain the corresponding armrest member at a selected one of a plurality of angular positions relative to the respective side frame.

5 Claims, 7 Drawing Sheets

FOLDABLE LEISURE CHAIR

BACKGROUND OF THE INVENTION

1. Field of the Invention

The invention relates to a leisure chair, more particularly to a foldable leisure chair having a seat unit and pivotable armrest members that can be maintained at a selected angular position relative to the seat unit.

2. Description of the Related Art

A conventional foldable leisure chair generally comprises a seat unit, a backrest unit connected to a rear end of the seat unit and pivotable to a desired angular position relative to the seat unit, and a pair of armrest members coupled respectively to left and right sides of the seat unit. Each of the armrest members is generally pivotable relative to the seat unit between a folded position, and an unfolded position. It is desirable that the armrest members can be adjusted among a plurality of unfolded positions to provide improved comfort to a user's arms.

SUMMARY OF THE INVENTION

The object of the present invention is to provide a foldable leisure chair having a seat unit and pivotable armrest members that can be maintained at a selected one of a plurality of angular positions relative to the seat unit.

Accordingly, a foldable leisure chair of the present invention comprises a seat unit including a pair of side frames that are spaced apart from each other in a left-right direction, a backrest unit connected to the side frames of the seat unit, a pair of armrest members spaced apart from each other in the left-right direction, and a pair of support units. A left one of the armrest members is connected to a left one of side frames and is pivotable relative to the left one of the side frames about an axis that is parallel to the left-right direction. A right one of the armrest members is connected to a right one of said side frames and is pivotable relative to the right one of the side frames about the axis. Each of the armrest members has a pivot segment that is connected pivotally to a corresponding one of the side frames, and a coupling segment that extends from a front end of the pivot segment. Each of the support units includes an elongated coupling seat, an elongated seat-engaging rod, and an adjusting mechanism. The coupling seat has a seat body defining a receiving space therein, and having a pivot end part that is connected pivotally to a respective one of the side frames and an open end part that is opposite to the pivot end part in a longitudinal direction transverse to the axis and that is formed with an opening in spatial communication with the receiving space. The seat-engaging rod has an engaging end part extending telescopically into the receiving space of the coupling seat through the opening, and a connecting end part opposite to the engaging end part in the longitudinal direction and connected pivotally to the coupling segment of a corresponding one of the armrest members. The coupling seat of each of the supporting units is pivoted away from the respective one of the side frames, and the seat-engaging rod of a corresponding one of the support units is moved away from the pivot end part of the coupling seat of the corresponding one of the support units in the longitudinal direction when a corresponding one of the armrest members is pivoted away from a corresponding one of the side frames. The coupling seat of each of the supporting units is pivoted toward the corresponding one of the side frames, and the seat-engaging rod of the corresponding one of the support units is moved toward the pivot end part of the coupling seat of the corresponding one of the support units in the longitudinal direction when the corresponding one of the armrest members is pivoted toward the corresponding one of the side frames. The adjusting mechanism is disposed in the receiving space of the coupling seat for positioning the seat-engaging rod relative to the coupling seat so as to maintain the corresponding one of the armrest members at a selected one of a plurality of angular positions relative to the corresponding one of the side frames.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
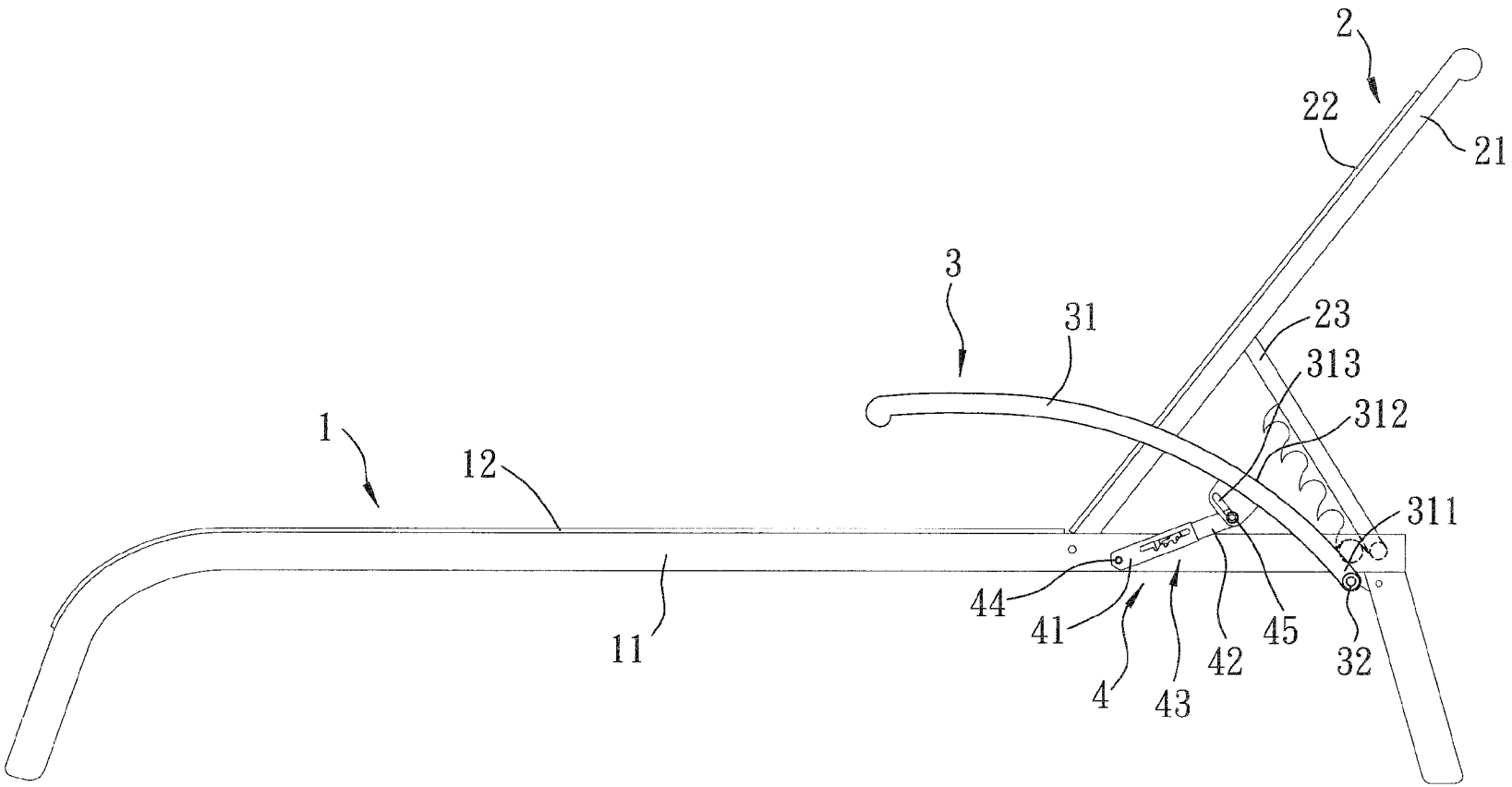
FIG. 1 is a side view of a preferred embodiment of a foldable leisure chair according to the invention.
Figure 2:
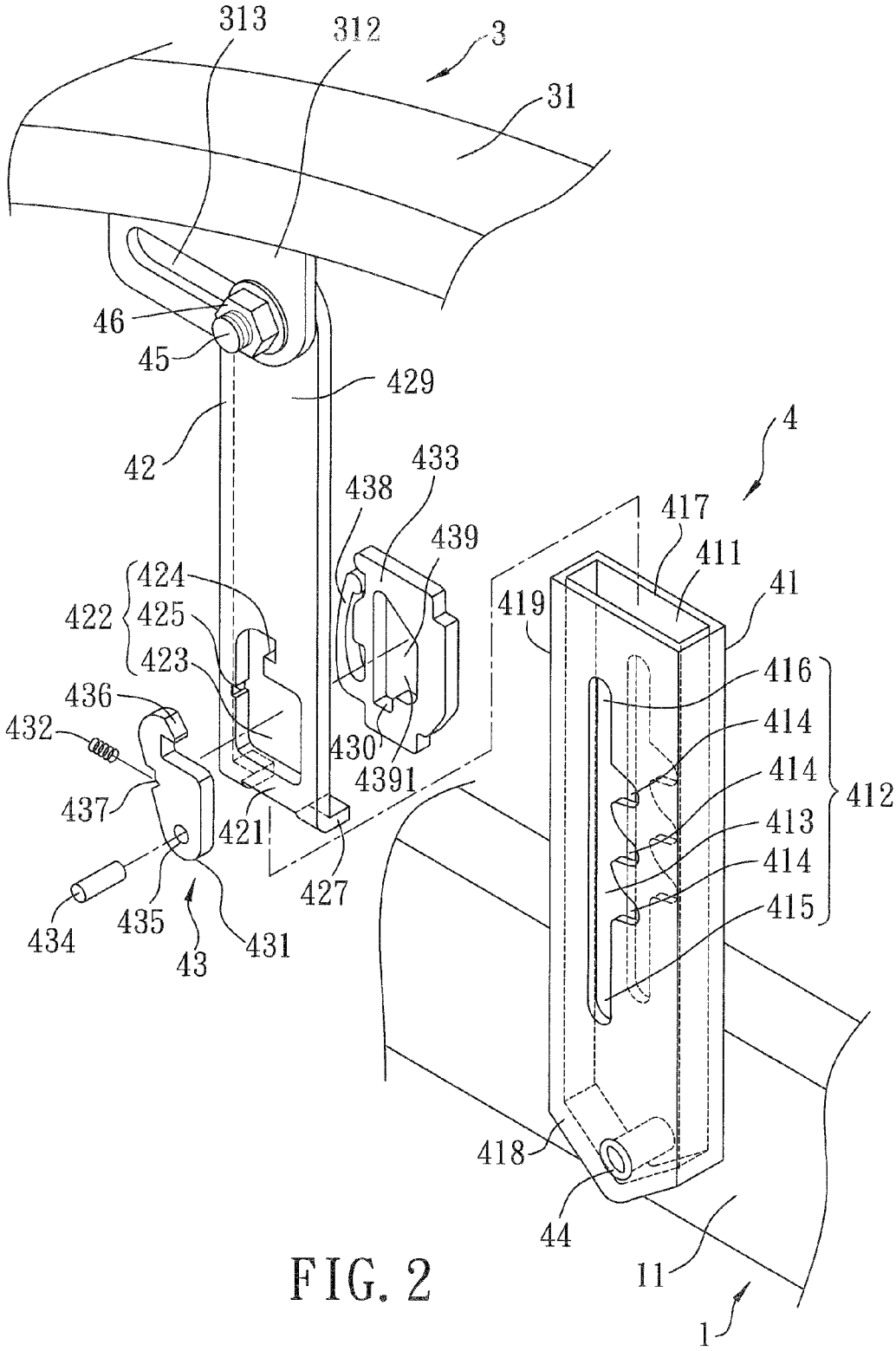
FIG. 2 is a partly exploded perspective view of a support unit of the preferred embodiment.

As shown in FIGS. 1 and 2, the preferred embodiment of a foldable leisure chair according to the present invention comprises a seat unit 1, a backrest unit 2, an armrest unit 3, and a pair of support units 4 (only one is visible).

The seat unit 1 includes a pair of side frames 11 (only one is visible) that are spaced apart from each other in a left-right direction, and a seat member 12 disposed between the side frames 11.

The backrest unit 2 includes a backrest frame 21 connected pivotally to the side frames 11 of the seat unit 1, a backrest member 22 provided on the backrest frame 21, and a backrest-support mechanism 23 connected between the backrest frame 21 and the side frames 11 for positioning the backrest frame 21 at a desired angular position relative to the side frames 11. Since the feature of this invention does not reside in the backrest support mechanism 23, further details of the same are omitted herein for the sake of brevity.

The armrest unit 3 includes a pair of armrest members 31 (only one is visible) that are spaced apart from each other in the left-right direction, and a connecting rod 32 connected to bottom sides of the side frames 11, extending parallel to the left-right direction, and interconnecting the armrest members 31. As such, a left one of the armrest members 31 is connected to a left one of the side frames 11 and is pivotally relative to the left one of the side frames 11 about a rod axis of the connecting rod 32, and a right one of the armrest members 31 is connected to a right one of the side frames 11 and is pivotable relative to the right one of the side frames 11 about the rod axis of the connecting rod 32. Each of the support units 4 is connected pivotally between a respective one of the armrest members 31 and a corresponding one of the side frames 11. Since the foldable leisure chair of the invention has a symmetric structure in a front-rear direction, only one side frame 11, one armrest member 31, and one support unit 4 will be described in the following description for the sake of brevity.

The armrest member 31 has a pivot segment 311 connected pivotally to the connecting rod 32 so as to be pivotable relative to the side frame 11, and a coupling segment 312 extending from a front end of the pivot segment 311 and formed with an elongated adjusting slot 313.

The support unit 4 includes an elongated coupling seat 41, an elongated seat-engaging rod 42, and an adjusting mechanism 43.

The coupling seat 41 has a seat body that has an inner surface defining a receiving space 411 therein. The seat body has a pivot end part 418 that is connected pivotally to the side frame 11, and an open end part 419 that is opposite to the pivot end part 418 in a longitudinal direction transverse to the rod axis of the connecting rod 32, and that is formed with an opening 417 in spatial communication with the receiving space 411. The seat body is formed with an adjusting groove 412 that is in spatial communication with the receiving space 411. The adjusting groove 412 has a slide groove portion 413 extending in the longitudinal direction, and a plurality of spaced-apart engaging groove portions 414 extending downwardly from the slide groove portion 413. Each of the engaging groove portions 414 extends obliquely toward the pivot end part 418 of the seat body. The adjusting groove 412 further has an inner groove portion 415 extending from a front end of the slide groove portion 413 in the longitudinal direction, and an outer groove portion 416 extending from a rear end of the slide groove portion 413 in the longitudinal direction.

The seat-engaging rod 42 has an engaging end part 421 extending telescopically into the receiving space 411 of the coupling seat 41 through the opening 417 and provided with a bent end member 427 projecting in a transverse direction parallel to the rod axis of the connecting rod 32, and a connecting end part 429 opposite to the engaging end part 421 in the longitudinal direction and connected pivotally to the coupling segment 312 of the armrest member 31. The engaging end part 421 of the seat-engaging rod 42 is formed with a through hole 422. The through hole 422 has a plate-receiving hole portion 423, a bent hole portion 424 extending from a rear end of the plate-receiving hole portion 423 and bent downwardly, and a retaining hole portion 425 extending upwardly from the plate-receiving hole portion 423.

The adjusting mechanism 43 includes a swingable plate 431, a resilient member 432, a limiting plate 433, and an engaging pin 434.

The swingable plate 431 is retained swingably in the through hole 422 of the seat-engaging rod 42. The swingable plate 431 has a connecting plate portion 435 retained swingably in the plate-receiving hole portion 423 of the through hole 422, a hook plate portion 436 extending from a rear end of the connecting plate portion 435 and retained swingably in the bent hole portion 424 of the through hole 422, and a retaining groove 437 formed in an upper end of the swingable plate 431 and registered with the retaining hole portion 425 of the through hole 422.

The resilient member 432 has opposite ends that are retained respectively in the retaining groove 437 of the swingable plate 431 and the retaining hole portion 425 of the through hole 422 of the seat-engaging rod 42, and that abut respectively and resiliently against the swingable plate 431 and the seat-engaging rod 42.

The limiting plate 433 is disposed at a lateral side of the seat-engaging rod 42, and has a through hole 439 that is registered with the through hole 422 of the seat-engaging rod 42 and the adjusting groove 412 of the coupling seat 41 in the transverse direction parallel to the rod axis of the connecting rod 32. The through hole 439 has a main hole part 4391 and a guide hole part 430 extending forwardly from an upper portion of a front end of the main hole part 4391. The limiting plate 433 further has a damping portion 438 extending therefrom and abutting resiliently against the inner surface of the seat body of the coupling seat 41 such that the limiting plate 433 is in frictional contact with the inner surface of the seat body of the coupling seat 41.

The engaging pin 434 is coupled co-movably to the swingable plate 431 and extends movably through the adjusting groove 412 of the coupling seat 41, the through hole 422 of the seat-engaging rod 42, and the through hole 439 of the limiting plate 433.

The support unit 4 further includes a rear pivot axle 45 coupled co-movably to the connecting end part 429 of the seat-engaging rod 42 and engaging movably the adjusting slot 313 of the coupling segment 312 of the armrest member 31, and a front pivot axle 44 for coupling pivotally the pivot end part 418 of the coupling seat 41 to the side frame 11.

Before use, the armrest member 31 is positioned at a folded position (see FIG. 3) close to the side frame 11. At this time, the coupling seat 41 is pivoted to be generally parallel to the side frame 11, while the majority of the seat-engaging rod 42 extends into the receiving space 411 of the coupling seat 41 with the engaging pin 434 being retained releasably in a front end of the inner groove portion 415 of the adjusting groove 412 and engaging the guide hole part 430 of the through hole 439 of the limiting plate 433.

Figure 4:
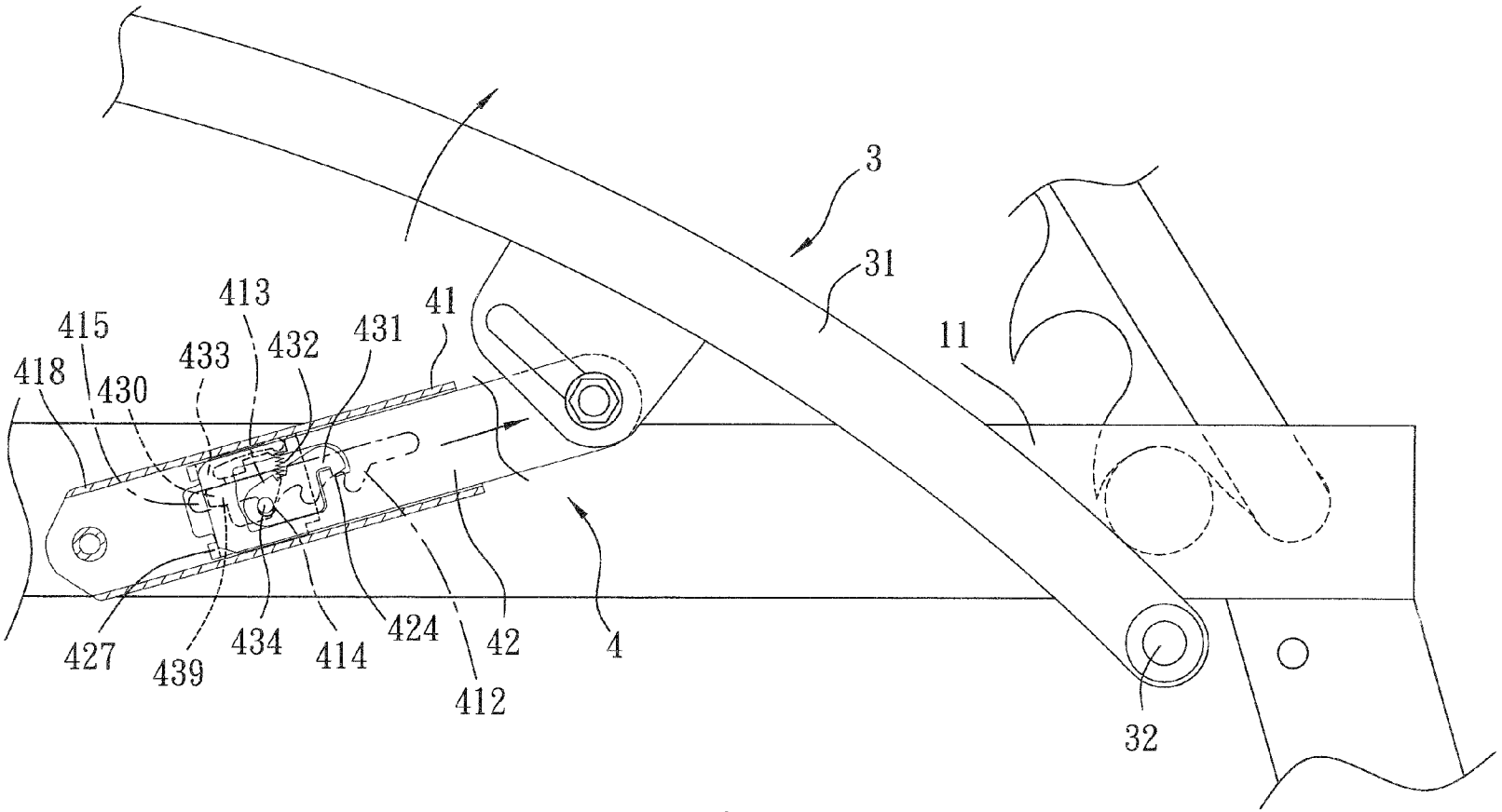
FIG. 4 is another fragmentary partly sectional view of the preferred embodiment, illustrating the armrest member at a first angular position relative to a side frame.
Figure 5:
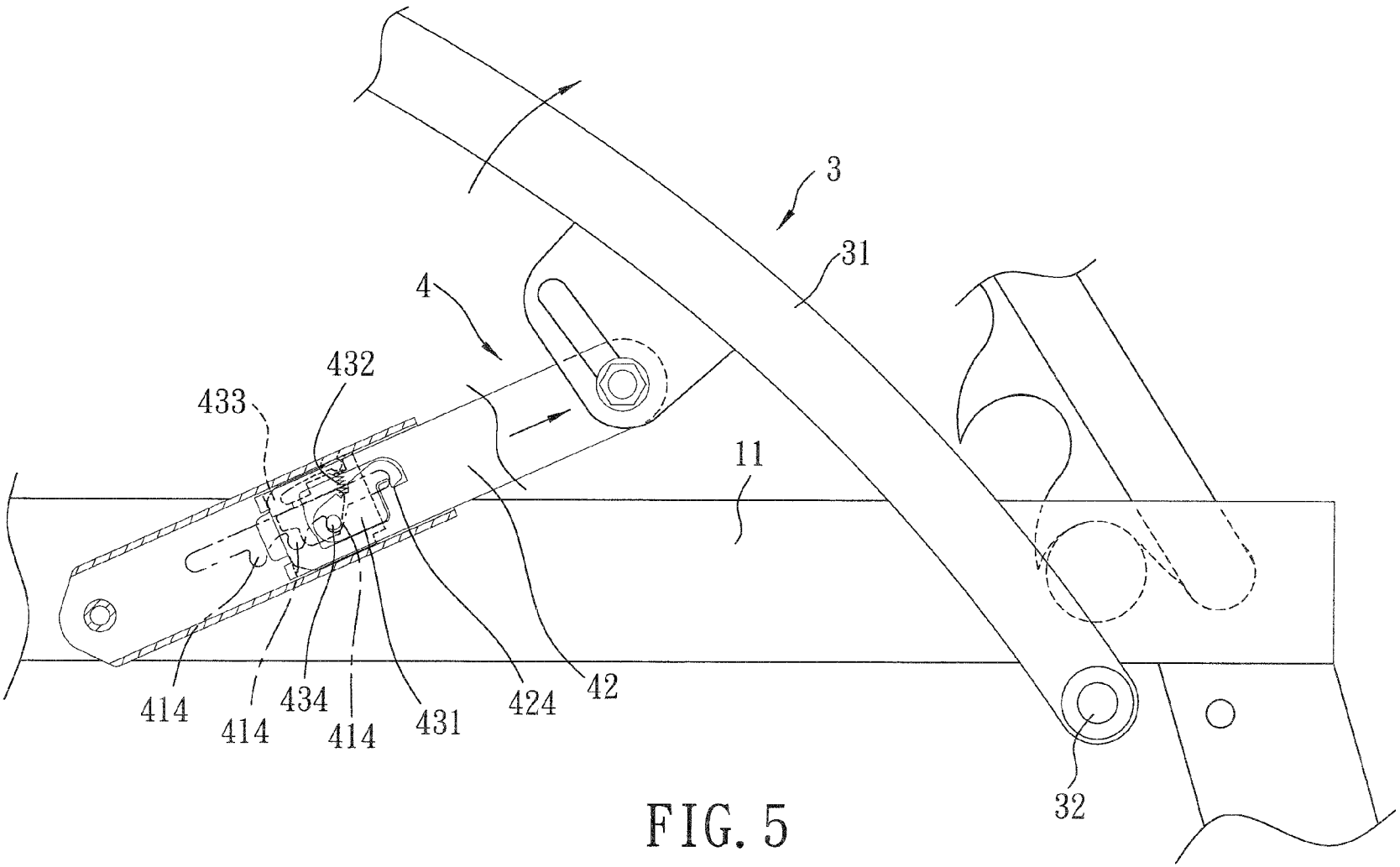
FIG. 5 is a view similar to FIG. 4, but illustrating the armrest member at another angular position relative to the side frame.
Figure 6:
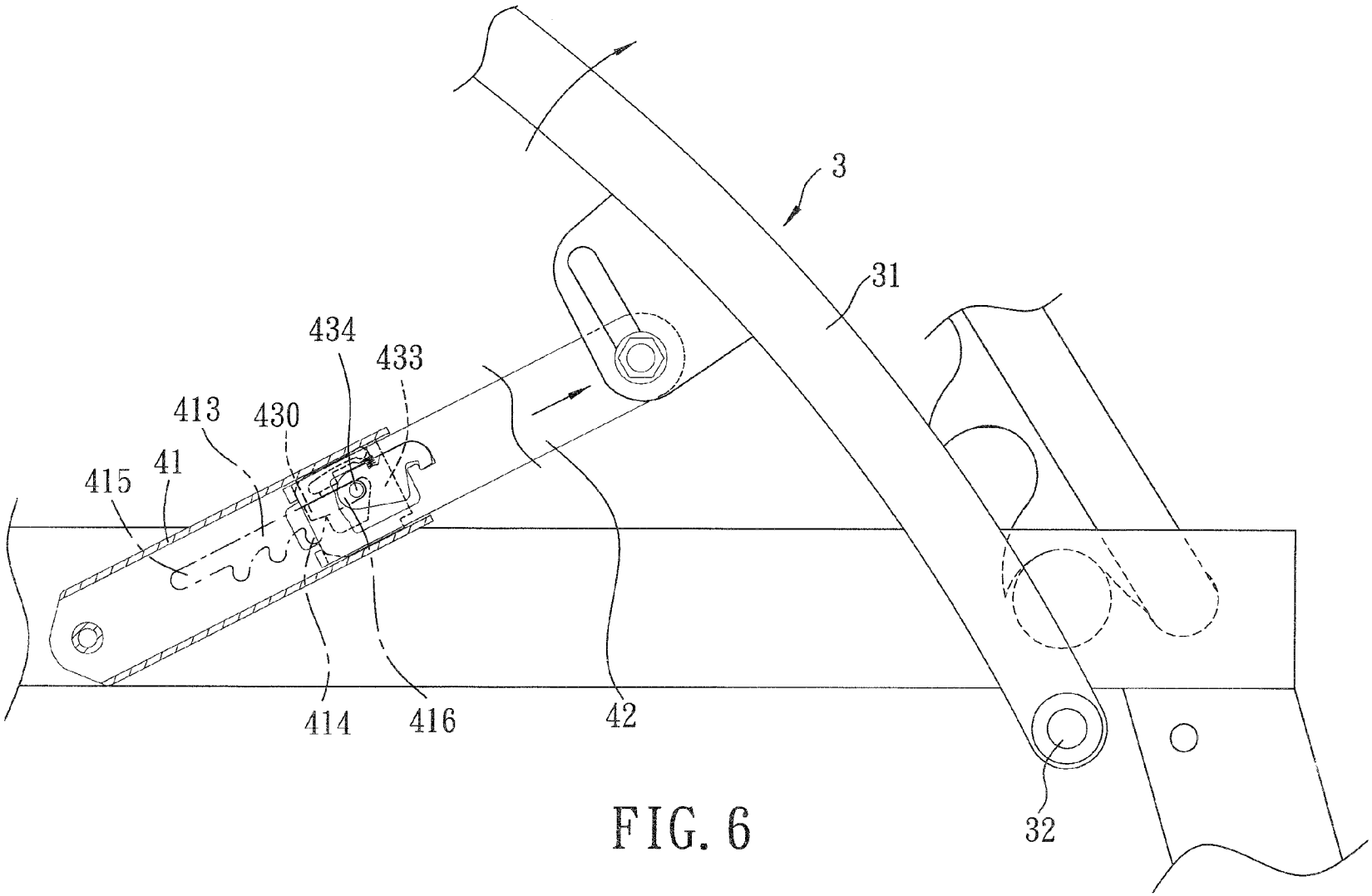
FIG. 6 is another view similar to FIG. 4, but illustrating the armrest member at still another angular position relative to the side frame.
Figure 7:
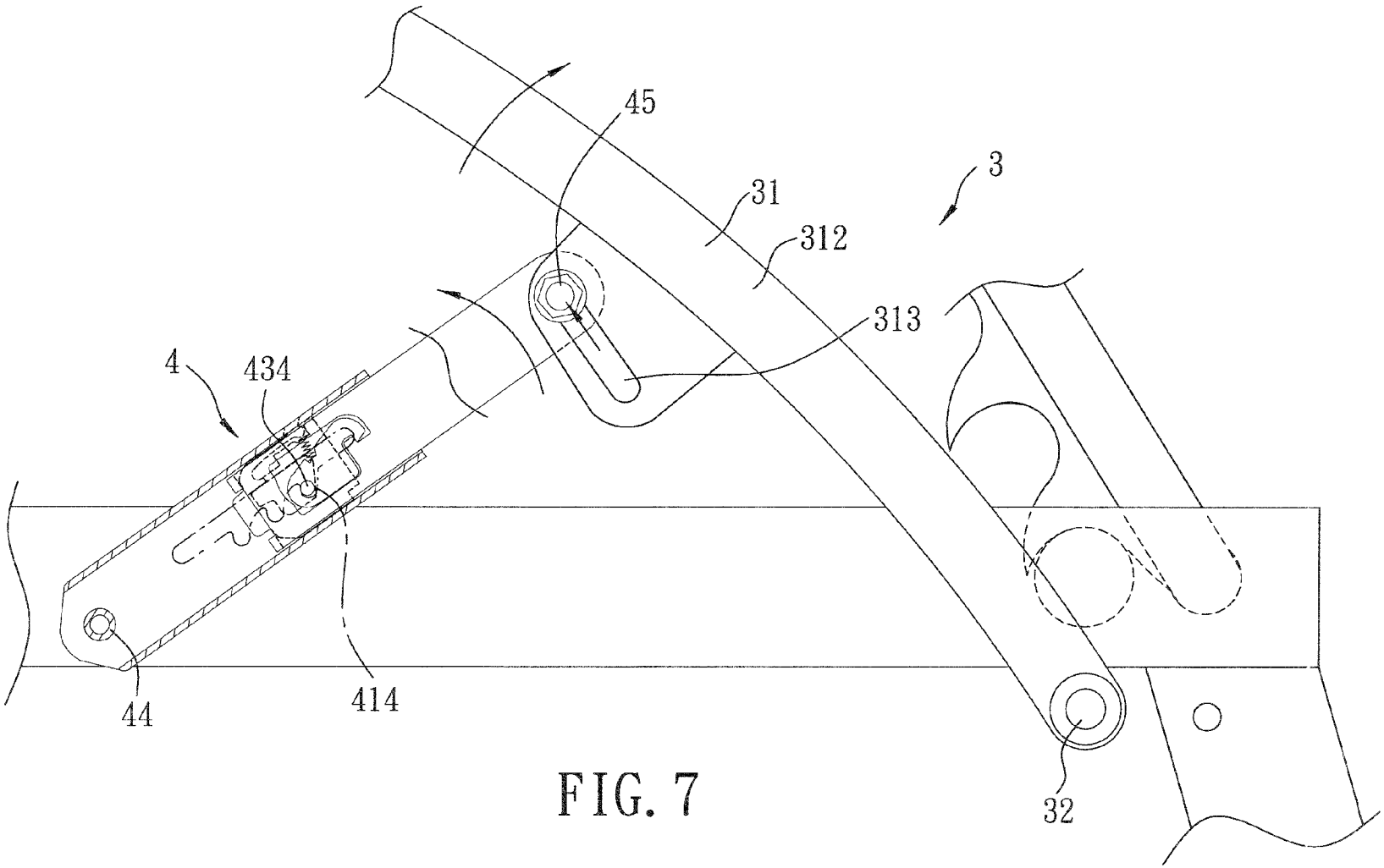
FIG. 7 is a view similar to FIG. 6, but illustrating the armrest member at yet another angular position relative to the side frame.

In use, the armrest member 31 can be pivoted away from the side frame 11 from the folded position to a selected one of a plurality of angular positions relative to the side frame 11. For example, as shown in FIG. 4, the armrest member 31 can be pivoted from the folded position to a first angular position. As the armrest member 31 is pivoted away from the side frame 11, the coupling seat 41 is pivoted away from the side frame 11, and the seat-engaging rod 42 is moved away from the pivot end part 418 of the coupling seat 41 in the longitudinal direction. During the telescopic movement of the seat-engaging rod 42 relative to the coupling seat 41, the swingable plate 431 is moved together with the seat-engaging rod 42, so that the engaging pin 434 is driven to be separated from the guide hole part 430 of the through hole 439 of the limiting plate 433 and to move along the slide groove portion 413 from the inner groove portion 415. When the bent end member 427 of the seat-engaging rod 42 comes into contact with the limiting plate 433, the limiting plate 433 is driven to move together with the seat-engaging rod 42 to move along the slide groove portion 413. When the engaging pin 434 is moved to a position aligned with a frontmost one of the engaging groove portions 414, it is biased to engage the frontmost one of the engaging groove portions 414 by a restoring force of the resilient member 432 so as to position the seat-engaging rod 42 at the first angular position relative to the coupling seat 41. Referring to FIGS. 5 and 6, when the armrest member 31 is further pivoted away from the side frame 11, the engaging pin 434 is driven to be disengaged from the frontmost one of the engaging groove portions 414 and to move together with the seat-engaging rod 42 and the limiting plate 433 so as to engage a selected one of the remaining engaging groove portions 414 in the same manner to thereby maintain the armrest member 31 at a selected one of the angular positions relative to the side frame 11. Further referring to FIG. 7, when the engaging pin 434 engages the rearmost one of the engaging groove portions 414 as illustrated in FIG. 5, the armrest member 31 can still be further pivoted slightly away from the side frame 11 by loosening a lock nut 46 (see FIG. 2) and moving the rear pivot axle 45 to a front end of the adjusting slot 313 of the coupling segment 312 of the armrest member 31. Subsequently, the lock nut 46 is tightened to resecure the rear pivot axle 45 to the coupling segment 312 of the armrest member 31. On the contrary, the armrest member 31 can also be pivoted slightly toward the side frame 11 when the rear pivot axle 45 moves toward a rear end of the adjusting slot 313.

Figure 3:
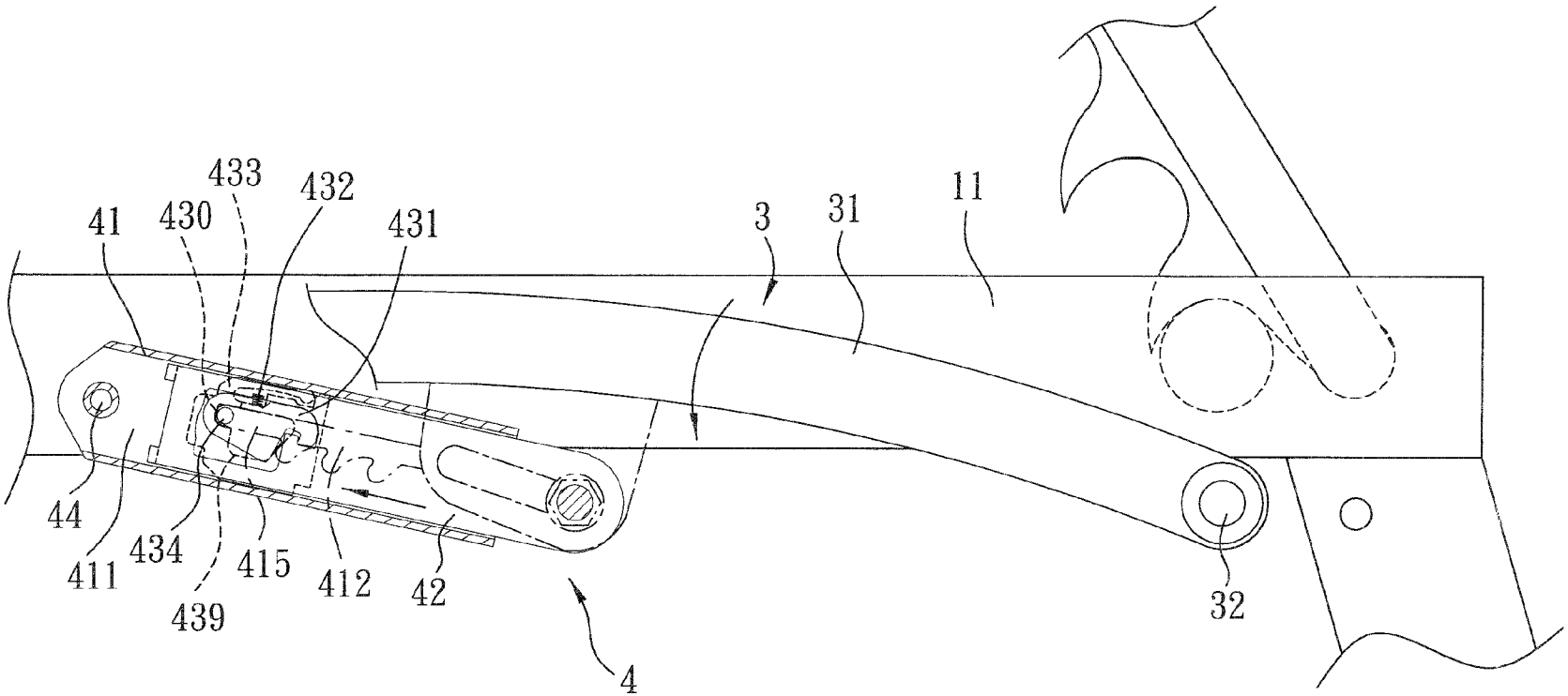
FIG. 3 is a fragmentary partly sectional view of the preferred embodiment, illustrating an armrest member at a folded position.

The armrest member 31 has to be further pivoted away from the side frame 11 until the engaging pin 434 is retained releasably in a rearmost end of the outer groove portion 416 of the adjusting groove 412 before the armrest member 31 can be folded. At the beginning of the folding movement of the armrest member 31, the coupling seat 41 is pivoted toward the side frame 11, and the seat-engaging rod 42 is moved toward the pivot end part 418 of the coupling seat 41 in the longitudinal direction. Also, the engaging pin 434 is moved back into the slide groove portion 413 and hence is retained once again in the guide hole part 430 of the through hole 439 of the limiting plate 433, so that the limiting plate 433 is driven to move together with the engaging pin 434 to arrest the engagement between the engaging pin 434 and the engaging groove portions 414 of the adjusting groove 412 during the rest of the pivoting movement of the armrest member 31 toward the side frame 11. Therefore, the armrest member 31 can be fully folded back to the folded position as illustrated in FIG. 3. To sum up, by virtue of the support unit 4, the armrest member 31 can be positioned at a selected angular position relative to the side frame 11, thereby resulting in convenience during use.

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

What is claimed is:

1. A foldable leisure chair comprising:

a seat unit including a pair of side frames that are spaced apart from each other in a left-right direction;

a backrest unit connected to said side frames of said seat unit;

a pair of armrest members spaced apart from each other in the left-right direction, a left one of said armrest members being connected to a left one of said side frames and being pivotable relative to said left one of said side frames about an axis that is parallel to the left-right direction, a right one of said armrest members being connected to a right one of said side frames and being pivotable relative to said right one of said side frames about the axis, each of said armrest members having a pivot segment that is connected pivotally to a corresponding one of said side frames, and a coupling segment that extends from a front end of said pivot segment; and a pair of support units, each of which includes an elongated coupling seat that has a seat body defining a receiving space therein, and having a pivot end part that is connected pivotally to a respective one of said side frames and an open end part that is opposite to said pivot end part in a longitudinal direction transverse to the axis and that is formed with an opening in spatial communication with said receiving space, an elongated seat-engaging rod that has an engaging end part extending telescopically into said receiving space of said coupling seat through said opening, and a connecting end part opposite to said engaging end part in the longitudinal direction and connected pivotally to said coupling segment of a corresponding one of said armrest members, said coupling seat of each of said supporting units being pivoted away from the respective one of said side frames, and said seat-engaging rod of a corresponding one of said support units being moved away from said pivot end part of said coupling seat of the corresponding one of said support units in the longitudinal direction when a corresponding one of said armrest members is pivoted away from a corresponding one of said side frames, said coupling seat of each of said supporting units being pivoted toward the corresponding one of said side frames, and said seat-engaging rod of the corresponding one of said support units being moved toward said pivot end part of said coupling seat of the corresponding one of said support units in the longitudinal direction when the corresponding one of said armrest members is pivoted toward the corresponding one of said side frames, and an adjusting mechanism that is disposed in said receiving space of said coupling seat for positioning said seat-engaging rod relative to said coupling seat so as to maintain the corresponding one of said armrest members at a selected one of a plurality of angular positions relative to the corresponding one of said side frames.

2. The foldable leisure chair as claimed in claim 1, wherein:

said seat body of said coupling seat of each of said support units is formed with an adjusting groove that is in spatial communication with said receiving space, and that has a slide groove portion extending in the longitudinal direction, and a plurality of spaced-apart engaging groove portions extending downwardly from said slide groove portion;

said engaging end part of said seat-engaging rod of each of said support units is formed with a through hole; and said adjusting mechanism of each of said support units includes a swingable plate retained swingably in said through hole of said seat-engaging rod of a corresponding one of said support units, a resilient member having opposite ends that abut respectively and resiliently against said swingable plate and said seat-engaging rod of the corresponding one of said support units, a limiting plate longitudinally movable in said receiving space of said coupling seat of a corresponding one of said support units, disposed at a lateral side of said seat-engaging rod of the corresponding one of said support units, and having a through hole that is registered with said through hole of said seat-engaging rod and said adjusting groove of said coupling seat of the corresponding one of said support units in a transverse direction parallel to the axis, and an engaging pin coupled co-movably to said swingable plate and extending movably through said adjusting groove of said coupling seat of the corresponding one of said support units, said through hole of said seat-engaging rod of the corresponding one of said support units, and said through hole of said limiting plate;

wherein said engaging pin is movable along said slide groove portion of said adjusting groove of said coupling seat of the corresponding one of said support units during the telescopic movement of said seat-engaging rod relative to said coupling seat of the corresponding one of said support units, and is biased to engage a selected one of said engaging groove portions by a resilient force of said resilient member so as to position said seat-engaging rod relative to said coupling seat of the corresponding one of said support units.

3. The foldable leisure chair as claimed in claim 2, wherein:

said adjusting groove of said seat body of said coupling seat of each of said support units further has an inner groove portion extending from a front end of said slide groove portion in the longitudinal direction, and an outer groove portion extending from a rear end of said slide groove portion in the longitudinal direction;

said through hole in said seat-engaging rod of each of said support units has a plate-receiving hole portion, and a bent hole portion extending from a rear end of said plate-receiving hole portion and bent downwardly;

said swingable plate of said adjusting mechanism of each of said support units has a connecting plate portion retained swingably in said plate-receiving hole portion of said through hole of said seat-engaging rod of a corresponding one of said support units and coupled to said engaging pin of said adjusting mechanism of the corresponding one of said support units, and a hook plate portion extending from a rear end of said connecting plate portion and retained swingably in said bent hole portion of said through hole of said seat-engaging rod of the corresponding one of said support units;

said through hole in said limiting plate of said adjusting mechanism of each of said support units has a main hole part and a guide hole part extending forwardly from an upper portion of a front end of said main hole part;

said engaging pin of said adjusting mechanism of each of said support units being retained releasably in said outer groove portion of said adjusting groove of said connecting seat of the corresponding one of said support units and said guide hole part of said through hole of said limiting plate of said adjusting mechanism of a corresponding one of said support units when folding the corresponding one of said armrest members so as to arrest the engagement between said engaging pin and said engaging groove portions of said adjusting groove of said coupling seat of the corresponding one of said supporting units during the pivoting movement of the corresponding one of said armrest members toward the corresponding one of said side frames; and said engaging pin of said adjusting mechanism of each of said support units being retained releasably in said inner groove portion of said adjusting groove of said connecting seat of the corresponding one of said support units and separated from said guide hole part of said through hole of said limiting plate of said adjusting mechanism of the corresponding one of said support units when unfolding the corresponding one of said armrest members so as to permit the engagement between said engaging pin and said engaging groove portions of said adjusting groove of said coupling seat of the corresponding one of said supporting units during the pivoting movement of the corresponding one of said armrest members away from the corresponding one of said side frames.

4. The foldable leisure chair as claimed in claim 3, wherein:

said seat body of said connecting seat of each of said support units has an inner surface defining said receiving space; and said limiting plate of said adjusting mechanism of each of said support units further has a damping portion extending therefrom and abutting resiliently against said inner surface of said seat body of said coupling seat of a corresponding one of said support units such that said limiting plate is in frictional contact with said inner surface of said seat body of said coupling seat.

5. The foldable leisure chair as claimed in claim 1, wherein:

said coupling segment of each of said armrest members is formed with an adjusting slot having front and rear ends; and each of said support units further includes a rear pivot axle coupled co-movably to said connecting end part of said seat-engaging rod and engaging movably said adjusting slot, each of said armrest members being pivoted slightly away from the corresponding one of said side frames when said rear pivot axle moves toward said front end of said adjusting slot of a corresponding one of said armrest members, each of said armrest members being pivoted slightly toward the corresponding one of said side frames when said rear pivot axle moves toward said rear end of said adjusting slot of the corresponding one of said armrest members.

* * * * *